US007412915B2

(12) United States Patent
Schincariol

(10) Patent No.: US 7,412,915 B2
(45) Date of Patent: Aug. 19, 2008

(54) METHOD OF SECURING A CONNECTION IN A DRIVE ASSEMBLY AND A SECURELY CONNECTED DRIVE ASSEMBLY

(76) Inventor: Cal Schincariol, 421 Arlington Blvd., St. Clair Beach, Ontario (CA) N6N 2K1

( * ) Notice: Subject to any disclaimer, the term of this patent is extended or adjusted under 35 U.S.C. 154(b) by 0 days.

(21) Appl. No.: 11/652,574

(22) Filed: Jan. 12, 2007

(65) Prior Publication Data

US 2007/0169591 A1 Jul. 26, 2007

Related U.S. Application Data

(60) Provisional application No. 60/760,393, filed on Jan. 20, 2006.

(51) Int. Cl.
*B25B 23/16* (2006.01)

(52) U.S. Cl. ..... 81/177.85; 81/184

(58) Field of Classification Search ..... 81/177.85, 81/184; 403/179, 223
See application file for complete search history.

(56) References Cited

U.S. PATENT DOCUMENTS

| | | | | |
|---|---|---|---|---|
| 2,038,840 | A | 4/1936 | Hall | |
| 2,490,478 | A * | 12/1949 | Schaedler | 279/19.6 |
| 3,222,959 | A * | 12/1965 | Clark | 81/124.6 |
| 3,274,330 | A | 9/1966 | Becker et al. | |
| 3,824,331 | A | 7/1974 | Mixon, Jr. et al. | |
| 4,530,261 | A | 7/1985 | Ventura | |
| 4,573,251 | A | 3/1986 | Hillyard | |
| 5,003,849 | A | 4/1991 | Lawrey | |
| 7,082,864 | B1 * | 8/2006 | Weber | 81/184 |

* cited by examiner

*Primary Examiner*—David B Thomas
(74) *Attorney, Agent, or Firm*—Clark & Brody

(57) ABSTRACT

A socket and drive member used in a manufacturing process for driving fasteners is coupled together using an elastic sleeve. The sleeve is placed on one of the socket and drive and then positioned to cover a joint created when the socket and drive member are coupled together. The sleeve uses friction and/or vacuum to maintain the connection at the joint, thus removing the need for fasteners to maintain the joint connection.

10 Claims, 2 Drawing Sheets

METHOD OF SECURING A CONNECTION IN A DRIVE ASSEMBLY AND A SECURELY CONNECTED DRIVE ASSEMBLY

This application claims priority under 35 USC 119(e) from application No. 60/760,393, filed on Jan. 20, 2006.

FIELD OF THE INVENTION

The present invention relates to the attachment of a drive member to a socket in a drive assembly. More particularly, the present invention relates to using an elastic sleeve made of a rubber or plastic material that is used to secure the connection between the socket and drive member.

DESCRIPTION OF THE RELATED ART

Tools having a drive member and socket assembly are used in a variety of manufacturing, fastening or repair environments. The drive and socket assembly includes a drive member coupled to a socket. In one use, the drive member and socket may be cylindrical in shape, and the socket has an end adapted to insert, remove or rundown bolts/screws repetitively in manufacturing operations, such as the automotive industry. For example, the drive and socket assembly is rotated to tighten or loosen a screw quickly.

An example of a prior art drive and socket assembly 100 is depicted FIG. 1. This assembly includes a drive member 102 and a socket 104, an o-ring 106, and pin 108. O-ring 106 and pin 108 are used to couple the drive member 102 and socket 104 together, and to prevent wear and tear on the assembly. More specifically, the socket 104 has a groove 110, and bore 112, the outer ends of the bore terminating in the groove 110. The end 114 of the drive member 102 has another bore 116. The socket 102 has a recess 118 sized to receive the end 114 of the drive member. Once the drive member 102 and socket 104 are coupled, the bores 112 and 116 are aligned so that the pin 108 can engage the bores and maintain a joint connection between the socket 104 and drive member 102. The o-ring 108 is placed in the groove 110 to keep the pin in place.

The prior art connection used in the prior art socket and drive member assembly can be problematic during use in a manufacturing operation. High volume and repetitive operations may result in wear and tear on the assembly, and the joint connection is compromised. Further, the o-ring 106 can deteriorate due to the oil used with the drive assembly 100. Without a functional o-ring, the pin 108 may slip out of the bores and the drive member and socket can become separated. Moreover, the pin 108 can break during usage. These disruptions can cause downtime during the manufacturing operation and lost productivity.

Consequently, there is a need for an improved connection between the socket and drive member of a drive assembly. The present invention solves this need by providing an improved connection that eliminates the need for an o-ring and pin, and the problems associated with the use of these components to maintain the joint connection.

DETAILED DESCRIPTION OF THE DISCLOSED EMBODIMENTS

Figure 1:
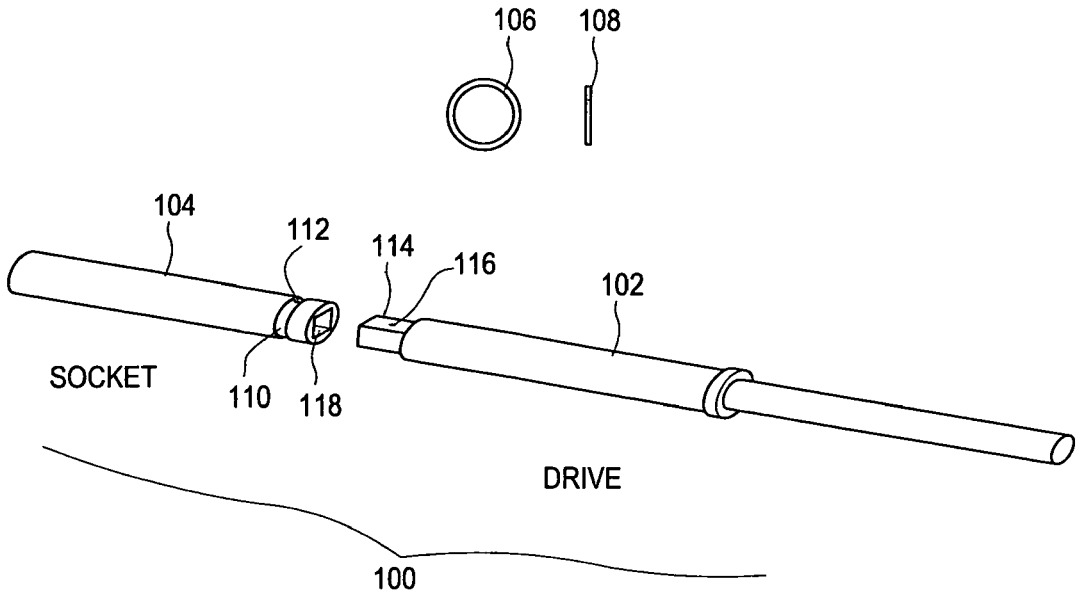
PRIOR ART FIG. 1
FIG. 1 is an exploded view of a prior art drive assembly.

The present invention relates to a drive assembly adapted for turning a socket attached to an end of the drive member of the assembly and a novel way to maintain a connection between the socket and the drive member. In one embodiment, the socket is especially adapted for inserting or removing bolts/screws and is similar to the assembly described in FIG. 1.

As part of maintaining the joint connection between the drive member and socket, the drive assembly uses an elastic sleeve having a diameter matched to the diameter of the drive member and socket. The sleeve can be made of any elastic material such as rubber, plastic or natural material, or a composite material, that allows the material to be placed, or rolled, or stretched onto the drive/shaft assembly. When positioned to cover a portion of the socket and the drive member, the sleeve generates a vacuum and/or friction condition holding the drive and socket together to secure the assembly. The sleeve should be elastic enough to be placed over a surface without losing its properties. Once placed over the surface, the sleeve should be able to stay in the placed position for long periods of time and under extreme conditions.

The present invention also relates to a sleeve fittable to a drive assembly. The sleeve couples a drive and a socket to create a vacuum or friction condition and to support a joining of the drive and the socket.

The present invention also relates to a method for supporting a drive assembly. In one mode, the method includes placing the elastic sleeve on the drive member first, either before or after the drive member and socket are connected. Once the connection is made, the elastic sleeve is moved so that it covers a portion of both the drive member and the socket. Once covered, the sleeve by vacuum and/or friction maintains the joint connection so that the drive member can rotate the socket as part of the manufacturing process.

In another mode, the elastic sleeve could be placed on the socket or drive member first, either before or after the socket is attached to the drive member. Once the connection is made between the drive member and socket, the elastic sleeve can be moved to cover portions of the drive member and socket to firmly couple the two pieces together.

Figure 2:
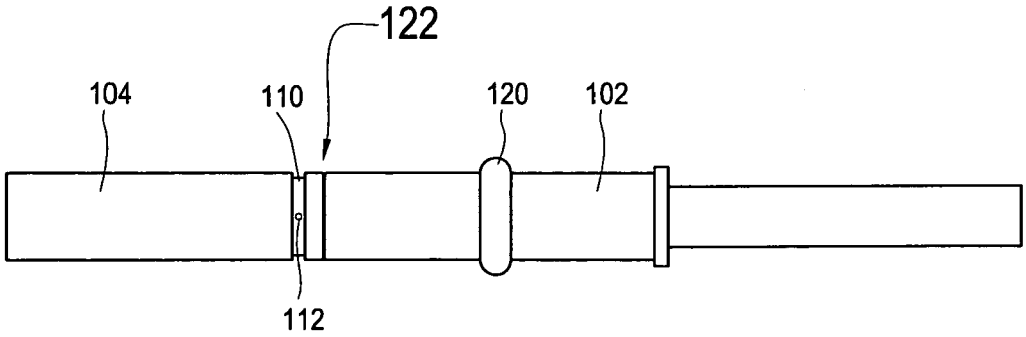
FIG. 2 shows a first step in a first embodiment of the method of the invention.
Figure 3:
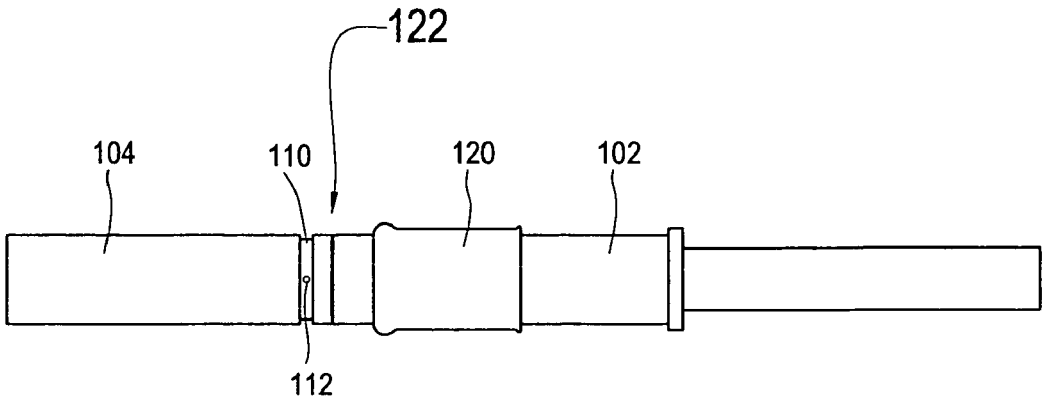
FIG. 3 shows a second step of the first embodiment of the invention.
Figure 4:
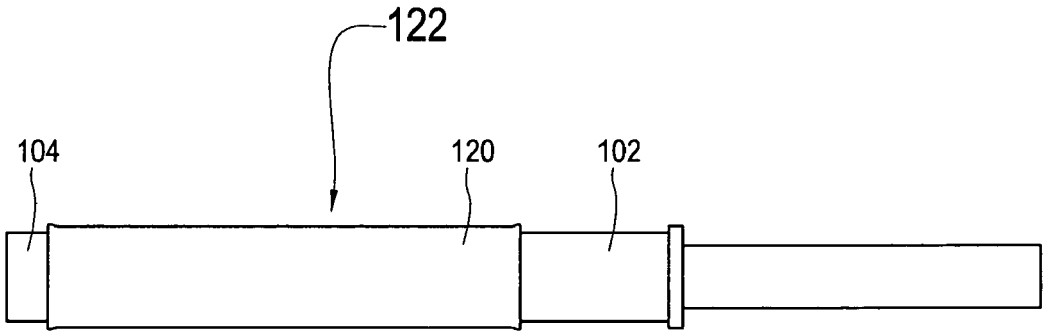
FIG. 4 shows a third step of the first embodiment of the invention.

The sleeve can be moved from its original position to cover the connection between the socket and drive member in any number of ways. One way is shown in FIGS. 2-4. In FIG. 2, the elastic sleeve 120 is shown in a rolled up state on the drive member 102, which has already been coupled to the socket 104 at connection 122. FIG. 3 shows the sleeve 120 partially unrolled in the direction of the socket 104 and connection 122. FIG. 4 shows the elastic sleeve 120 in a further unrolled state such that the sleeve 120 covers portions of the drive member 102, the connection 122, and the socket 104. In this state, the elastic sleeve maintains the connection 122 without the need for a pin and o-ring as used in the prior art.

While rolling of the sleeve 120 is illustrated in FIG. 2-4, the sleeve could be move in other ways, e.g., lifting an end of the sleeve from the drive member 102, and stretching it over the remainder of the drive member and socket to achieve the configuration shown in FIG. 4.

Figure 5:
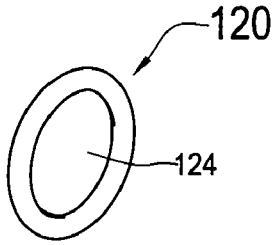
FIG. 5 shows the elastic sleeve of the invention in an at rest state.

In its normal state, the elastic sleeve 120 is shown in FIG. 5, which shows its through opening 124 that allows it to be fit on the drive member or sleeve. Because of its elastic nature, the sleeve 120 can lie flat on a surface when not being used on a drive assembly. The sleeve 120 provides support to the coupling of drive member 102 and socket 104. The sleeve may come in different diameter sizes to accommodate drive members and sockets of different sizes.

To remove the sleeve 120, it can be manually removed by rolling it up and off the drive member or socket or the like, or simply cut off using a sharp implement such as a knife.

While the sleeve is shown as a replacement for the pin and o-ring connection, it could be used in combination with these components. In this embodiment, if an o-ring or pin fails, the defective part may be replaced by rolling back the sleeve 120. Once the necessary repair is made, the sleeve 120 is rolled back to re-cover the connection.

While the prior art drive assembly is disclosed in terms of a socket adapted for fastener manipulation using a drive member, the elastic sleeve could be used to secure a connection between a drive member and other types of manufacturing tool. For example, the drive member may rotate a socket that is adapted for drilling, sanding, or the like. Thus, the socket is considered to not only encompass a tool for fastening or unfastening, but it is also considered to encompass other tools that may be used in for other rotary manufacturing operations.

As such, an invention has been disclosed in terms of preferred embodiments thereof which fulfills each and every one of the objects of the present invention as set forth above and provides a new and improved connection between a socket and a drive member of a drive assembly.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. A drive assembly comprising:

a drive member adapted to be rotated;

a socket coupled to the drive member at a connection; and an elastic sleeve capable of being rolled up on itself and having a diameter approximating a diameter of the drive and the socket, wherein the sleeve covers a portion of the drive member, connection, and socket thereby creating a vacuum or friction condition between the drive and socket to maintain the coupling of the drive member and socket.

2. The assembly of claim 1, wherein the elastic sleeve is made of rubber, plastic, natural, or composite material.

3. The assembly of claim 1, wherein the socket includes a circumferential groove at an end thereof.

4. The assembly of claim 3, wherein the socket includes through-holes within the circumferential groove, the through-holes having an end formed in the circumferential groove.

5. A method for supporting a drive assembly comprising a socket and a drive member, the socket having an end adapted for driving a fastener, the method comprising:

placing an elastic sleeve capable of being rolled up on itself on the drive member or socket, wherein the sleeve covers a section of an outer circumference of the drive member or socket;

coupling the drive member to the socket to form the drive assembly; and covering a portion of both of the drive member and the socket with the elastic sleeve to maintain a connection between the drive and the socket.

6. The method of claim 5, further comprising first placing the elastic sleeve onto the drive member, coupling the socket to the drive member, and then covering the portions of the drive member and socket.

7. The method of claim 6, wherein the elastic sleeve is placed on the drive member in a rolled up condition, and then unrolled as part of the covering step.

8. The method of claim 5, further comprising placing the elastic sleeve onto the socket, coupling the drive member to the socket, and then covering the portions of the drive member and socket.

9. The method of claim 8, wherein the elastic sleeve is placed on the socket in a rolled condition, and unrolled as part of the covering step.

10. The method of claim 5, wherein only the elastic sleeve maintains the connection between the drive member and socket.

* * * * *